US008978887B2

(12) United States Patent
Chen

(10) Patent No.: US 8,978,887 B2
(45) Date of Patent: Mar. 17, 2015

(54) RECEPTACLE FOR TOOL BIT

(71) Applicant: Hui-Chien Chen, Taichung (TW)

(72) Inventor: Hui-Chien Chen, Taichung (TW)

( * ) Notice: Subject to any disclaimer, the term of this patent is extended or adjusted under 35 U.S.C. 154(b) by 187 days.

(21) Appl. No.: 13/803,948

(22) Filed: Mar. 14, 2013

(65) Prior Publication Data

US 2014/0262877 A1 Sep. 18, 2014

(51) Int. Cl.
*B65D 85/28* (2006.01)
*B25H 3/00* (2006.01)

(52) U.S. Cl.
CPC ..... *B25H 3/003* (2013.01)
USPC ..... 206/372; 206/375; 206/377; 211/69

(58) Field of Classification Search
CPC ..... B25H 1/0042; B25H 3/023; B65D 85/20; B65D 73/0064; B65D 73/0057; B65D 73/0092; B65D 2201/00; B65D 85/24; B23Q 13/00; B25F 5/029
USPC ..... 206/349, 372–379, 804, 207, 249, 253, 206/255, 233, 234, 37.2, 39.4, 39.5; 211/69, 59.2, 70.6, 69.1, 69.5; 81/177.4, 490
See application file for complete search history.

(56) References Cited

U.S. PATENT DOCUMENTS 3,036,699 A * 5/1962 Huber ..... 206/306
4,795,286 A * 1/1989 Shimoishi et al. ..... 401/209
D404,070 S * 1/1999 Hasegawa ..... D19/51

* cited by examiner

*Primary Examiner* — Luan K Bui
*Assistant Examiner* — Rafael Ortiz

(57) ABSTRACT

A receptacle for tool bit includes a main body and a pressing member. For storing, the tool bit can be completely received in the main body. Damage caused by unpredictable collision or scratch is prohibited. For removing the tool bit, user can press the pressing member. The pressing member is then moved to push the tool bit out of the main body. Therefore, user can draw the tool bit out easily, even the tool bit is generally completely received in the main body.

10 Claims, 5 Drawing Sheets

RECEPTACLE FOR TOOL BIT

BACKGROUND OF THE INVENTION

1. Field of the Invention

The present invention relates to a receptacle for storing and taking tool bit conveniently.

2. Description of the Prior Art

Conventional receptacle for tool bit has several insertion grooves provided for tool bits to be inserted therein. Thus, tool bits are received in the receptacle for storing and transporting purposes.

However, the tool bits are inserted and tightly fitted in the insertion grooves of the receptacle. For retrieving the tool bit from the receptacle, user has to draw the tool bit hard. As a result, the user may get hurt.

In addition, the tool bits can not be completely inserted and received in the receptacle, or user could hardly approach and draw out the tool bits. However, the exposed portion of the tool bits would probably hurt people, damage tools or workpieces, or be damaged by surroundings.

The present invention is, therefore, arisen to obviate or at least mitigate the above mentioned disadvantages.

SUMMARY OF THE INVENTION

The main object of the present invention is to provide a receptacle for tool bit, so that user can store tool bit and take tool bit out conveniently.

To achieve the above and other objects, a receptacle for tool bit of the present invention includes a main body, and a pressing member.

The main body comprises a shell, a base, an insertion groove, and an aperture. The shell comprises an upper cover, a fore cover, a rear cover, and two side covers. A receiving space and an opening are defined between the upper cover, the fore cover, the rear cover, and the side covers. The opening is located under the shell. The opening communicates with the receiving space. The base is detachably received in the receiving space. The insertion groove comprises a first groove portion and a second groove portion. The first groove portion penetrates the upper cover. The first groove portion communicates with the receiving space. The second groove portion penetrates the base. The second groove portion communicates with the aperture.

The pressing member movably inserts in the aperture. One end of the pressing member is received in the second groove portion. Another end of the pressing member protrudes outwardly from the aperture.

Therefore, position of the tool bit received in the receptacle can be easily controlled by pressing the pressing member. User can store the tool bit in the receptacle or take the tool bit out freely.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
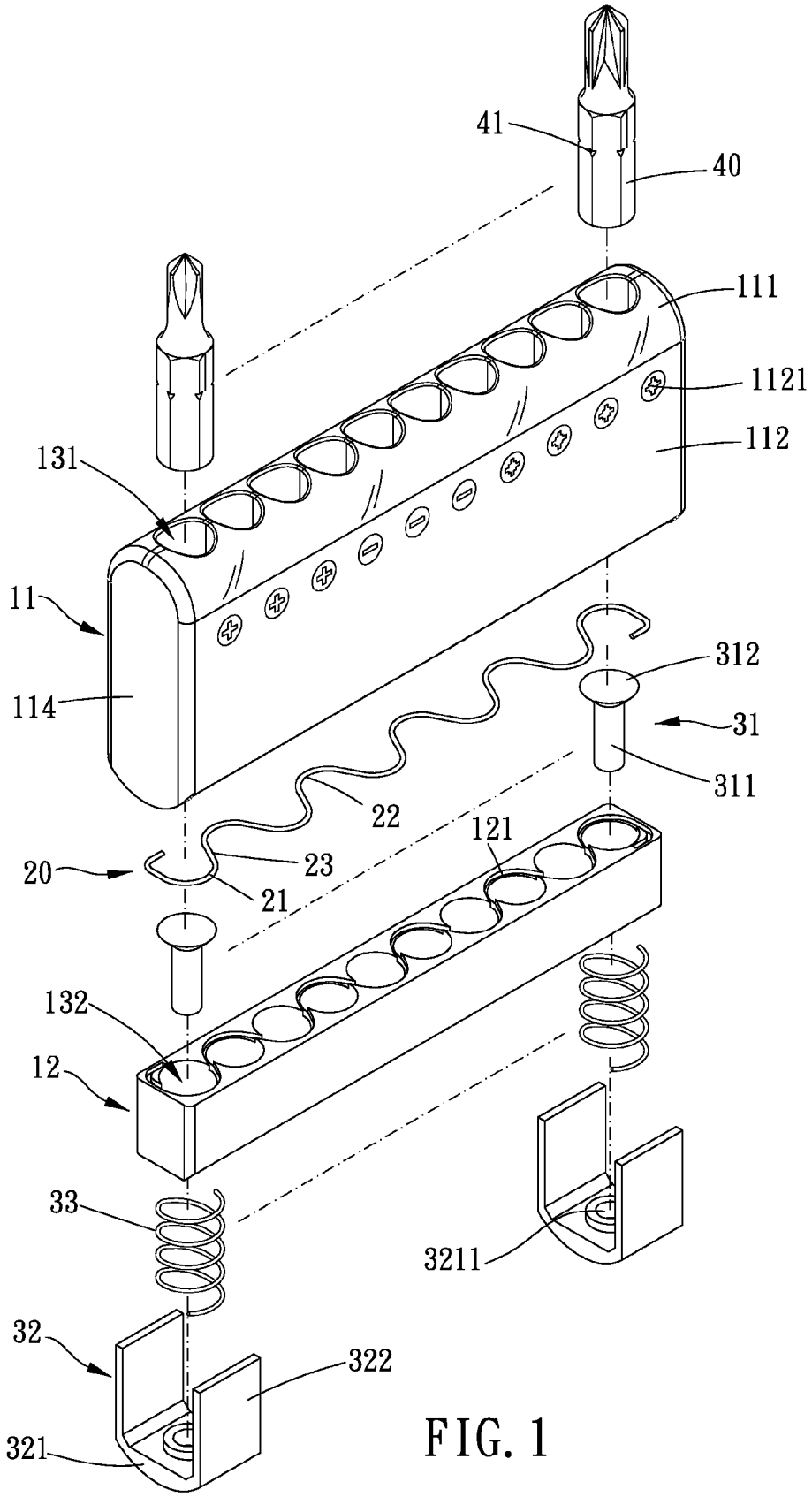
FIG. 1 is a breakdown drawing showing a first embodiment of the present invention.
Figure 2:
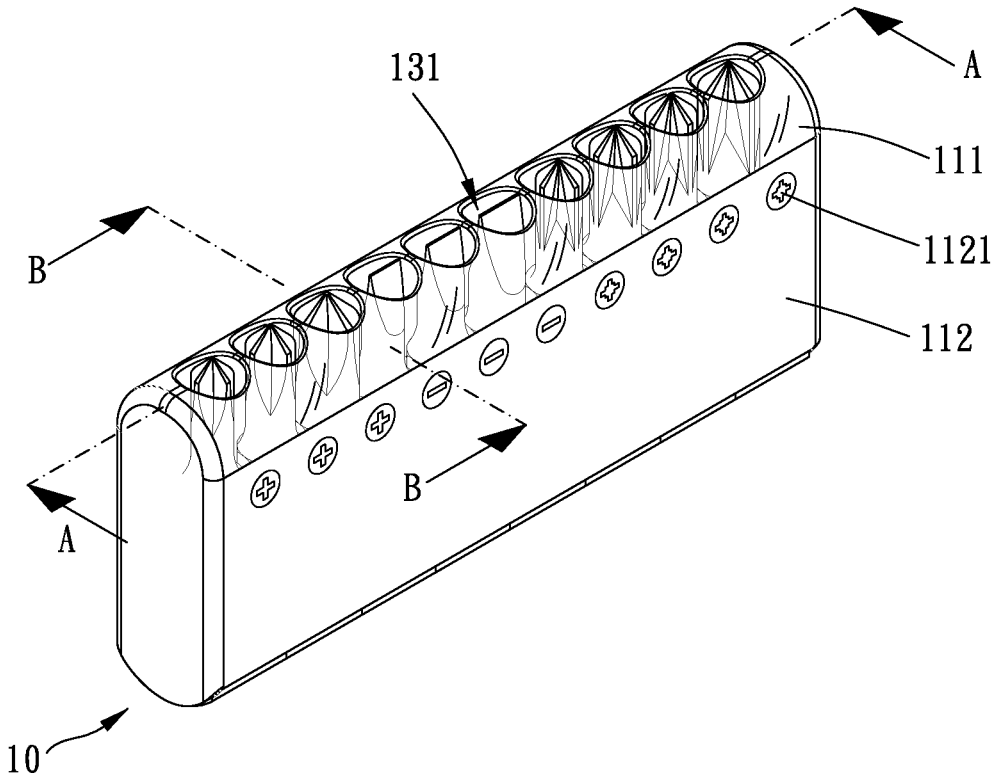
FIG. 2 is a stereogram showing a first embodiment of the present invention.
Figure 3:
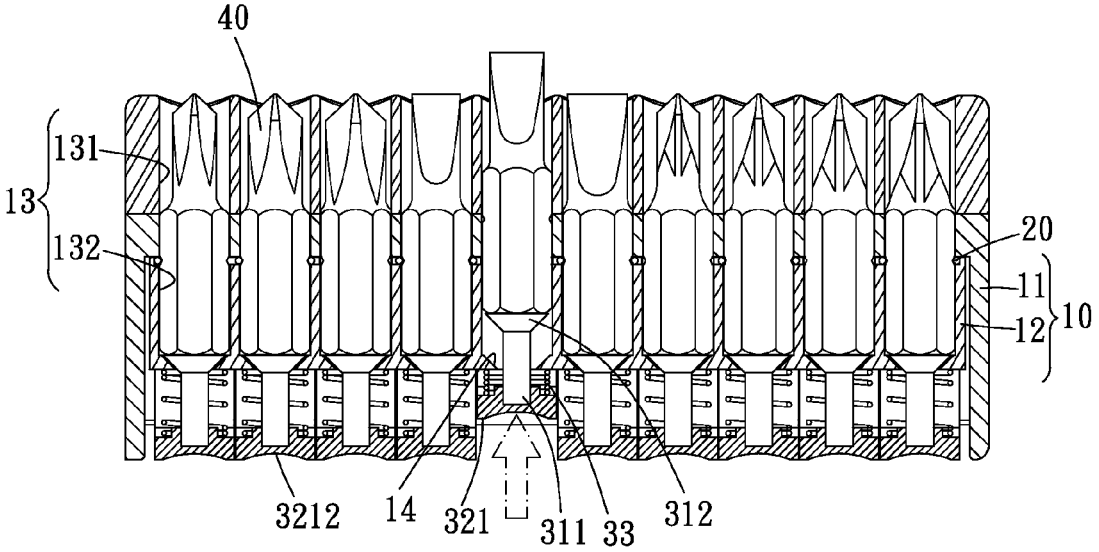
FIG. 3 is an A-A profile of FIG. 2.

Please refer to FIG. 1 to FIG. 3 for a first embodiment of the present invention. The receptacle for tool bit of the first embodiment of the present invention includes a main body 10, a positioning member 20, and several pressing members.

The main body 10 includes a shell 11, a base 12, several insertion grooves 13, and several apertures 14. The shell 11 includes an upper cover 111, a fore cover 112, a rear cover, and two side covers 114. The upper cover 111, the fore cover 112, the rear cover, and the side covers 114 define a receiving space and an opening therebetween. The opening is located under the shell 11, and communicates with the receiving space. In the present embodiment, the upper cover 111 is transparent. In other possible embodiments of the present invention, some of the other components may be transparent, or the shell may have no transparent component. The base 12 is received in the receiving space via the opening and arranged in the receiving space detachably and removably. Preferably, one of the shell 11 and the base 12 is disposed with an engagement member, and the other one is disposed with a buckle. The engagement member detachably engages the buckle so as to achieve engagement of the shell 11 and the base 12. The insertion grooves 13 are provided for tool bits 40 to be inserted therein respectively. The tool bits 40 which are suitable for screwdrivers and shown in the figures are taken for illustration and explanation only. The tool bit 40 is not required to fit with screwdrivers. Each of the insertion grooves 13 includes a first groove portion 131 and a second groove portion 132. The first groove portions 131 penetrate the upper cover 111 and communicate with the receiving space. Each of the second groove portions 132 penetrates the base 12 and corresponds to one of the first groove portion 131. The fore cover 112 is disposed with several mark portions 1121. The mark portions 1121 correspond to the first groove portions 131 respectively. Each of the apertures 14 is formed at a bottom portion of the base 12, and communicates with one of the second groove portions 132. Preferably, the second groove portion 132 has an inner diameter larger than a minimal inner diameter of the aperture 14. The apertures 14 shrink away from the second groove portions 132, so that the apertures 14 have reversed frusto-conical side walls respectively.

The positioning member 20 includes several first curved sections 21, several second curved sections 22, and several connecting sections 23. Each connecting section connects 23 one of the first curved sections 21 to one of the second curved sections 22, so that the positioning member 20 is formed with a wave-shaped appearance. Preferably, the positioning member 20 is provided with elasticity by bending a metal wire. A top portion of the base 12 is disposed with several restriction portions 121 which correspond to the second groove portions 132 respectively. The restriction portions 121 are formed as concaved arcs. The positioning member 20 is arranged on the top portion of the base 12. The first curved sections 21 and the second curved sections 22 abut against the restriction portion 121 respectively and protrude elastically in the second groove portions 132 respectively.

The pressing members are movably inserted in the apertures 14 respectively. One end of the pressing members 14 are respectively received in the second groove portions 13, and another end of the pressing members protrude outwardly from the apertures 14. In the present embodiment, each pressing member includes a pole portion 31 and a button 32. The pole portion 31 includes a pole 311 and a head portion 312. The pole 311 pierces movably in one of the apertures 14. The head portion 312 is disposed to one end of the pole 311, and is received in the second groove portion 132. An outer diameter of the head portion 312 is sized between the inner diameter of the second groove portion 132 and the minimal inner diameter of the aperture 14. Preferably, the head portion 312 of the pole portion has an appearance corresponding to the appearance of the aperture 14. The buttons 32 are movably disposed to one end of the main body 10, and protrude out of the apertures 14. In the present embodiment, each button 32 includes a bottom portion 321 and two side portions 322. The side portions 322 are disposed to two sides of the bottom portion 321. The side portions 322 correspond to each other, making the button 32 be formed in U-shaped. The side portions 322 of the button are slidably arranged by two sides of the base 12. The bottom portion 321 of the button is located under the aperture 14. The button 32 is completely received in the receiving space of the shell 10 together with the base 12, so that the button 32 does not protrude outwardly from the opening of the shell 10. Preferably, the top end of the bottom portion 321 of the button is formed with a positioning hole 3211. The pole 311 of the pole portion is inserted in the positioning hole 3211. The bottom end of the bottom portion 321 of the button is formed with a concaved and arc-shaped groove 3212. The desired appearance of the groove 3212 is provided for fitting with users' forefinger pulp, so that users can press the button 32 comfortably. The pressing member further includes an elastic member 33. The elastic member 33 is arranged between the top end of the bottom portion 321 of the button and the bottom portion of the base 12. The elastic member 33 provides elastic force, making the button 32 move generally away from the bottom portion of the base 12.

Figure 3A:
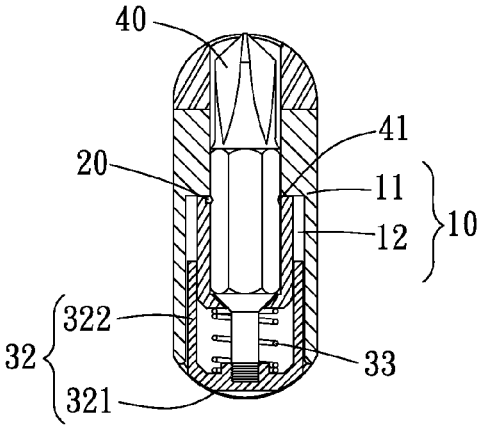
FIG. 3A is a B-B profile of FIG. 2.
Figure 3B:
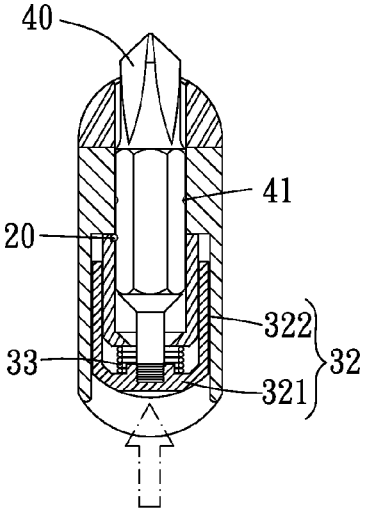
FIG. 3B is a schematic diagram showing a using condition of a first embodiment of the present invention for removing and withdrawing a tool bit.

Please refer to FIG. 3 and FIG. 3A. When a tool bit 40 is stored in the receptacle of the first embodiment of the present invention, the pole portion is located at a first position. The tool bit 40 is inserted in one of the insertion grooves 13. A bottom portion of the tool bit 40 abuts against the head portion 312 of the pole portion. Part of the positioning member 20 elastically engages the notch 41 of the tool bit 40, so that the tool bit 40 is held in the insertion groove 13. Please refer to FIG. 3 and FIG. 3B. When the user wants to take the tool bit 40 out, the bottom portion 321 of the button is pressed inwardly. Thus, the button 32 pushes the pole 311 of the pole portion to move along the aperture 14 toward the second groove portion 132. The pole portion is moved to a second position. The head portion 312 of the pole portion pushes the tool bit 40 to move outwardly via the first groove portion 131. The notch 41 of the tool bit is released from the positioning member 20, so that the tool bit 40 is no longer restricted by the positioning member 20. User can draw the tool bit 40 out easily. In addition, since the elastic member 33 is compressed by the bottom portion 321 of the button, the button 32 and the pole portion 31 would be moved back to the first position by the elastic member as soon as the user releases the button.

Figure 4:
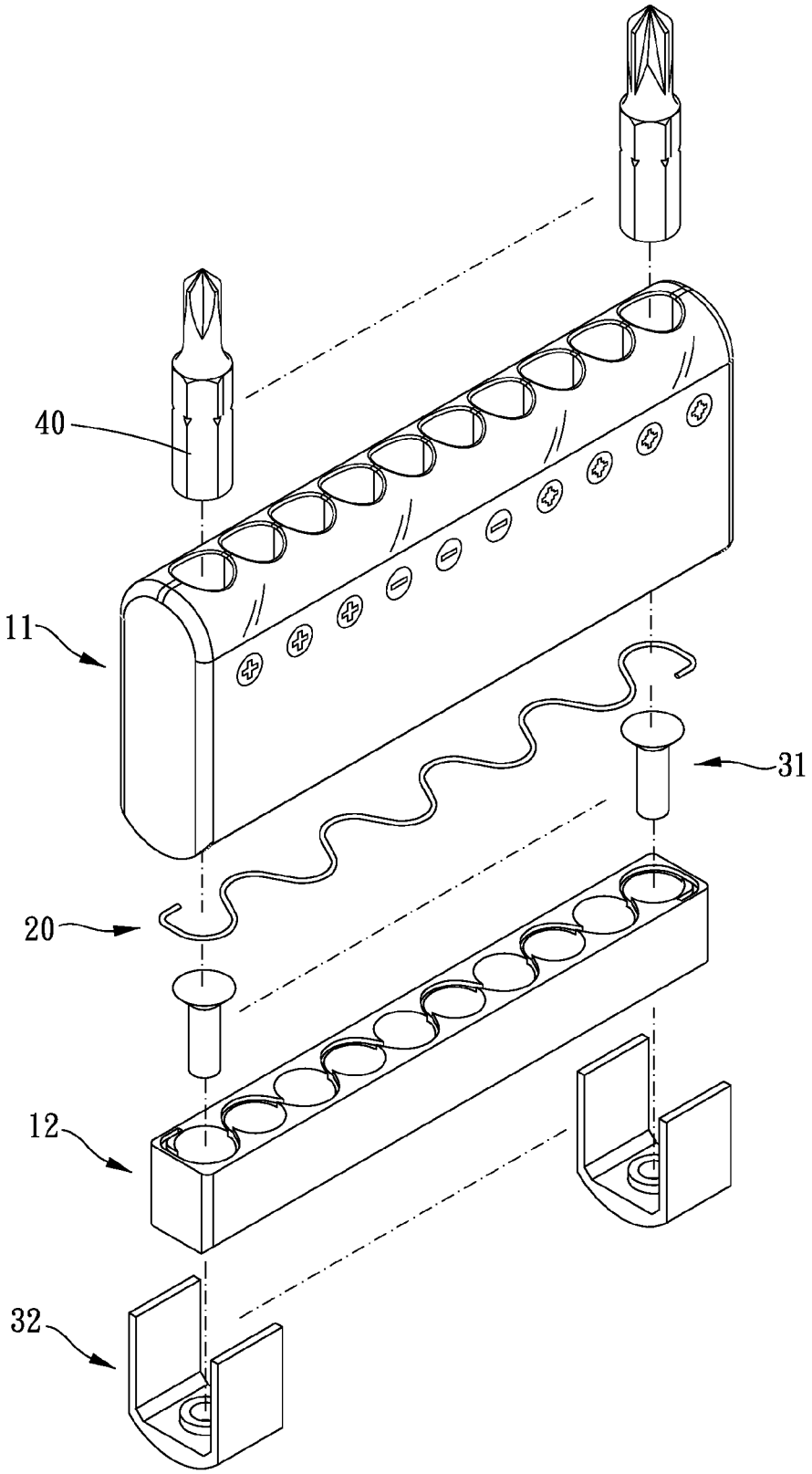
FIG. 4 is breakdown drawing showing a second embodiment of the present invention.

Please refer to FIG. 4 for a second embodiment of the present invention. The difference between the first and the second embodiments is that the elastic member is removed from the pressing member. Therefore, after the button 32 pushes the pole portion 31 to the second position, the pole portion 31 would be remained at the second position until a tool bit 40 abuts against and presses the pole portion 31 down to the first position.

Figure 5:
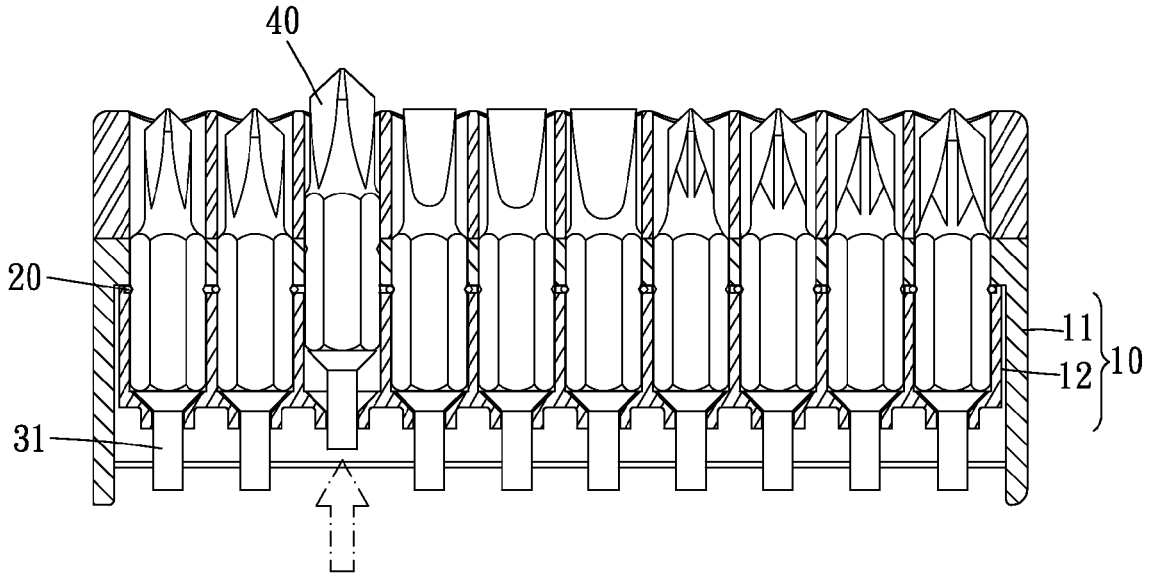
FIG. 5 is a profile showing a third embodiment of the present invention.

Please refer to FIG. 5 for a third embodiment of the present invention. The difference between the first and the third embodiments is that the elastic member and the button are removed from the pressing member. Therefore, user can press the pole portion 31 to move to the second position directly for taking the tool bit 40. When a tool bit 40 is received in the insertion groove, the tool bit 40 can abut against the pole portion 31, pushing the pole portion 31 to move back to the first position.

Therefore, the receptacle can keep and hold the tool bits 40 in the insertion grooves 13 by engagement of the positioning member 20. In addition, the tool bits 40 can be easily removed from the insertion groove 13 by push of the pressing member and releasement of the positioning member 20. The tool bits 40 can be drawn out of the receptacle easily.

In addition, the tool bits 40 are completely received in the insertion grooves 13 in storing. The tool bits, the users, and the surroundings are protected from unpredictable damage.

Besides, the upper cover 111 of the shell may be transparent. Even if the tool bits 40 are completely received in the insertion grooves 13, user can still recognize what kind of tool bit is received in a particular insertion groove. In addition, the mark portions 1121 disposed on the fore cover 112 can help in recognizing the tool bits 40, also.

What is claimed is:

1. A receptacle for tool bit, comprising:

a main body, comprising a shell, a base, an insertion groove for insertion of a tool bit from an outside of the main body, and an aperture, the shell comprising an upper cover, a fore cover, a rear cover, and two side covers, a receiving space and an opening being defined between the upper cover, the fore cover, the rear cover, and the side covers, the opening being located under the shell, the opening communicating with the receiving space, the base being detachably received in the receiving space, the insertion groove comprising a first groove portion and a second groove portion, the first groove portion penetrating the upper cover, the first groove portion communicating with the receiving space, the second groove portion penetrating the base, the second groove portion communicating with the aperture;

a pressing member, movably inserting in the aperture, one end of the pressing member being received in the second groove portion, another end of the pressing member protruding outwardly from the aperture;

wherein the aperture is disposed at a bottom side of the base remote from the upper cover and is located between the second groove portion and the opening;

wherein the pressing member is abuttable against an inner surface of the aperture and has a top surface located between the second groove portion and the aperture, and the top surface is for abutting against the tool bit which is inserted in the insertion groove;

wherein as the pressing member is pressed toward the second groove portion, the tool bit which is inserted in the insertion groove is pushed to move outward from the insertion groove.

2. The receptacle for tool bit of claim 1, wherein an inner diameter of the insertion groove is larger than a minimal inner diameter of the aperture, the pressing member comprises a pole portion, the pole portion comprises a pole and a head portion, the pole pierces movably in the aperture, the head portion is disposed to one end of the pole and has the top surface, the head portion is received in the second groove portion, an outer diameter of the head portion is sized between the inner diameter of the second groove portion and the minimal inner diameter of the aperture.

3. The receptacle for tool bit of claim 2, wherein the pressing member comprises a button, the button is movably disposed to one end of the main body, the button protrudes out of the aperture, the button pushes the pole portion to move toward the insertion groove.

4. The receptacle for tool bit of claim 3, wherein the button has a positioning hole, the pole of the pole portion is inserted in the positioning hole.

5. The receptacle for tool bit of claim 3, wherein the button is formed with a concaved and arc-shaped groove located at one end away from the pole portion.

6. The receptacle for tool bit of claim 3, wherein the pressing member comprises an elastic member, the elastic member is arranged between the button and a bottom portion of the main body, making the button move generally away from the bottom portion of the main body.

7. The receptacle for tool bit of claim 2, wherein the aperture shrinks away from the second groove, the aperture has a reversed frusto-conical side wall, the head portion of the pole portion has an appearance corresponding to an appearance of the aperture.

8. The receptacle for tool bit of claim 1, wherein the upper cover of the shell is transparent.

9. The receptacle for tool bit of claim 1, wherein the main body comprises plural insertion grooves, the shell is disposed with plural mark portions, each mark portion corresponds to one of the insertion grooves.

10. The receptacle for tool bit of claim 1, wherein the receptacle for tool bit further comprises a positioning member, the positioning member comprises plural first curved sections, plural second curved sections, and plural connecting sections, each connecting section connects one of the first curved sections to one of the second curved sections, the main body comprises plural insertion grooves, a top portion of the base is disposed with plural restriction portions, the restriction portions corresponds to the second groove portions of the insertion grooves respectively, the positioning member is arranged on the top portion of the base, the first curved sections and the second curved sections abut against the restriction portions respectively and protrude elastically in the second groove portions respectively.

* * * * *